US009022609B2

(12) United States Patent
Lau

(10) Patent No.: US 9,022,609 B2
(45) Date of Patent: May 5, 2015

(54) LUMINAIRE POWER SWITCH

(71) Applicant: Kenneth Lau, Carlsbad, CA (US)

(72) Inventor: Kenneth Lau, Carlsbad, CA (US)

( * ) Notice: Subject to any disclaimer, the term of this patent is extended or adjusted under 35 U.S.C. 154(b) by 86 days.

(21) Appl. No.: 13/937,033

(22) Filed: Jul. 8, 2013

(65) Prior Publication Data

US 2014/0160770 A1 Jun. 12, 2014

Related U.S. Application Data

(60) Provisional application No. 61/669,454, filed on Jul. 9, 2012.

(51) Int. Cl.

| | |
|---|---|
| ***F21V 25/04*** | (2006.01) |
| ***F21V 15/01*** | (2006.01) |
| ***F21S 8/08*** | (2006.01) |
| *F21W 131/103* | (2006.01) |

(52) U.S. Cl.

CPC ..... *F21V 25/04* (2013.01); *F21V 15/01* (2013.01); *F21S 8/086* (2013.01); *F21W 2131/103* (2013.01); *Y10S 362/802* (2013.01)

(58) Field of Classification Search

USPC ..... 362/205, 263, 265, 362, 652, 802; 200/303, 341

See application file for complete search history.

(56) References Cited

U.S. PATENT DOCUMENTS

| | | | | |
|---|---|---|---|---|
| 3,823,312 | A * | 7/1974 | Weinstein | 362/99 |
| 5,211,282 | A * | 5/1993 | Ting | 200/303 |
| 8,545,059 | B2 * | 10/2013 | Chen et al. | 362/285 |
| 2002/0145868 | A1 * | 10/2002 | Barton | 362/155 |
| 2011/0205746 | A1 * | 8/2011 | Lundin et al. | 362/373 |

* cited by examiner

*Primary Examiner* — Laura Tso

(74) *Attorney, Agent, or Firm* — Steven W. Webb

(57) ABSTRACT

A novel means for reducing the maintenance costs of cobra head lighting fixtures is presented, comprised of a new housing with a hinge at one end that allows the upper half of the housing to be lifted up for easy access to the lamp and ballast. There is a contact pressure switch in the enclosure which is opened electrically when the upper housing is lifted so that power to the entire enclosure is cut for the safety of the installer. The combination of the switch and the liftable upper housing reduces the steps necessary to do a bulb replacement.

2 Claims, 3 Drawing Sheets

LUMINAIRE POWER SWITCH

RELATED APPLICATIONS

The application claims the benefit of U.S. Provisional Patent Application 61/669,454, dated Jul. 9, 2012, and includes that application here by reference.

FIELD OF THE INVENTION

This invention is related to the field of lighting, with both outdoor and indoor applications.

BACKGROUND OF THE INVENTION

Outdoor lighting systems, such as induction lighting, can last approximately 100,000 hours before replacement; however, service and maintenance are still needed. These systems are used in applications such as street lighting fixtures that are generally described as a "cobra head", because of their shape.

The typical street light cobra head arrangement requires that the "cobra head" be opened with a downward-opening gate. Service call needs special bucket truck, often requiring two people with one directing traffic. The placement of the service gates for replacing lamps and replacing ballasts makes it difficult for workers to service a lamp from below, which can require the service personnel to work with their hands above their heads, looking up the entire time.

An innovation that allows the lamp housings to be serviced from above can ease the task of replacing luminaire components. The innovation supplies a fixed lower luminaire housing with a single-hinge flip-up top, or other means, that simultaneously switches off the power when it is opened and permits easy component replacement. An alternative to a flip-up hinge is an anchored, demountable hook.

This invention can be used in applications similar to the luminaire housing, where a light, a ballast, a transformer, or other electrical components need servicing at heights above the ground.

OBJECTS OF THE INVENTION

It is an object of the present invention to provide a modified lighting luminaire enclosure.

It is the object of the present invention that the lighting luminaire enclosure be constructed with a fixed lower part and a flip-up upper part.

It is a further object of this invention that said flip-up upper part turn off the power to the entire enclosure when it is opened by means of a passive switch.

DETAILED DESCRIPTION

Figure 1:
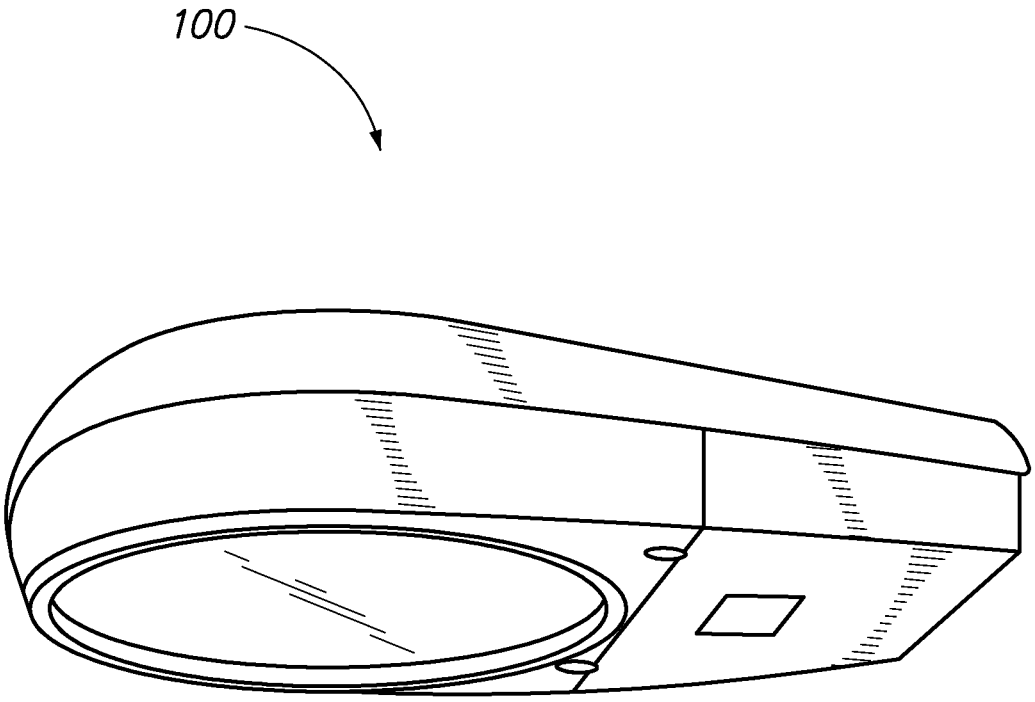
FIG. 1. Typical Cobra head lighting fixture
Figure 2:
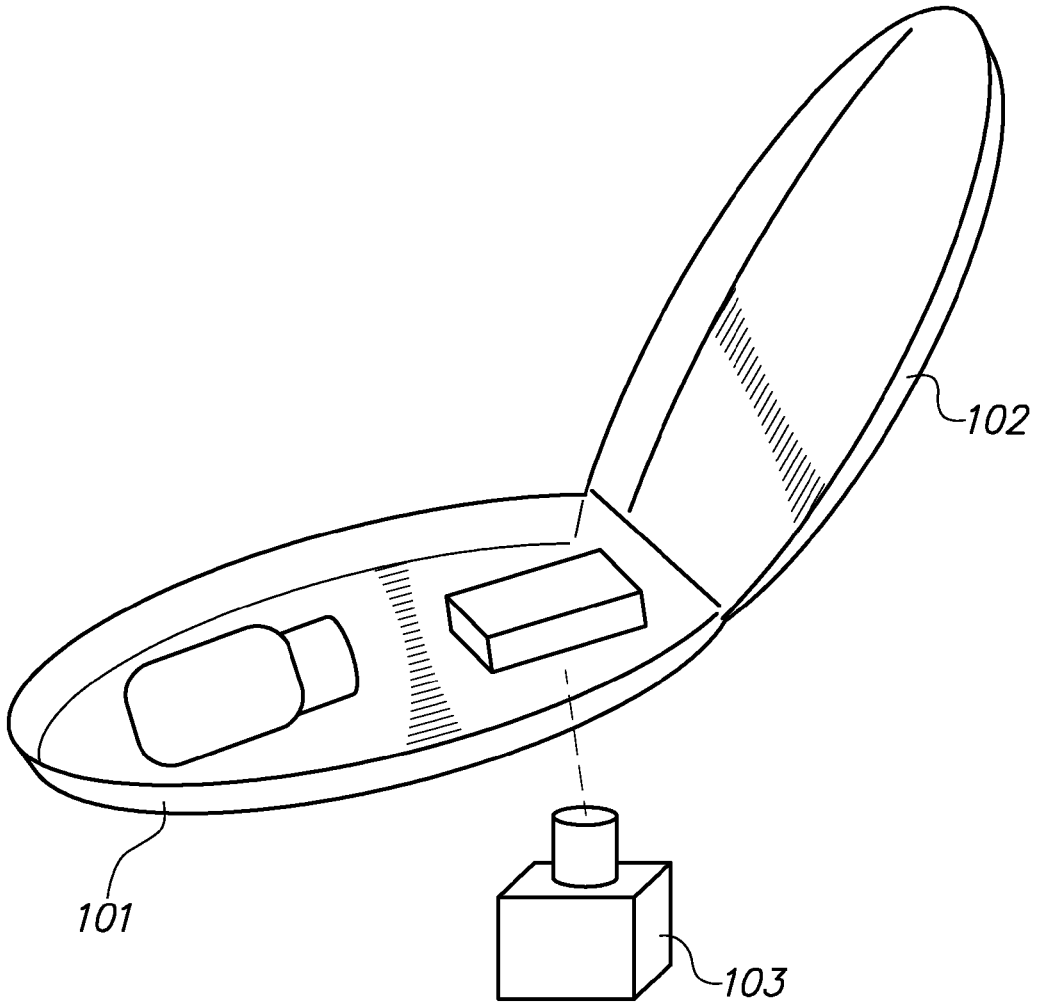
FIG. 2. New housing with top flipped up

FIG. 1 and FIG. 2 show the general configuration of a cobra head discharge lamp lighting fixture 100. There is a fixed lower housing 101 that contains an interior socket structure within which a lamp or light bulb can be mounted and a rotatable upper housing 102 that can be flipped up for easy access to the interior of the enclosure. The interior of the enclosure possesses a passive electrical switch 103 that controls the power to the enclosure and is opened by opening the upper housing 102.

Figure 3:
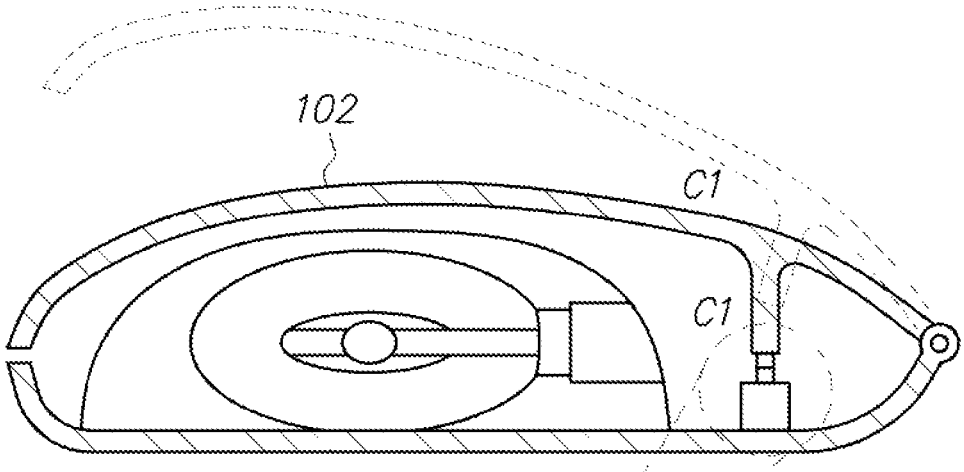
FIG. 3. Detailed cross-section of open enclosure with switch shown

FIG. 3 shows the details of the lamp system. The opened upper housing 102 shows a contact point 104 that when the housing is closed presses on the pushbutton 105 that closes the passive switch 103. The power to the enclosure is restored upon closing the upper housing 102 and interrupted by the opening of the switch 103 when the housing 102 is lifted.

Figure 4:
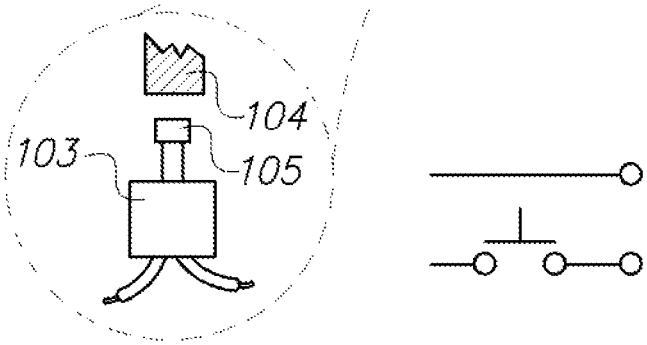
FIG. 4. Close-up of switch and switch contact

FIG. 4 is a close-up of the switch 103 contacted by the contact point 104. The electrical circuit supplied in FIG. 4 is a typical open-close power switch configuration.

While the foregoing describes a preferred and an alternative embodiment of the invention, variation on this design and equivalent designs may be resorted to in the scope and spirit of the claimed invention.

What is claimed is:

1. A lighting enclosure and power switch system, the system comprised of a cobra head discharge lamp lighting fixture and an electrical switch, the lighting fixture comprised of a fixed lower housing and a rotatable upper housing, said lower housing comprised of an interior socket structure with a lamp or light bulb mounted in said socket structure, said rotatable upper housing attached to said lower housing at one end by a rotatable connection means, the connection means oriented such that the upper housing can be flipped up for easy access to the interior of the lower housing, the interior of said lower housing possessing a passive electrical switch that controls the power to the entire lighting fixture, the switch placed on the inside surface of the lower housing, the switch possessing a pushbutton on its upper surface that opens and closes the switch electrically, the upper housing possessing a contact point projecting downwards from the interior surface of said upper housing such that when the upper housing is closed and mated with the lower housing said contact point presses on the pushbutton, which action closes the passive electrical switch providing power to the lighting fixture, the power to the lighting fixture cut upon opening the lighting fixture by lifting the upper housing around the rotatable connection means, which action releases pressure on the pushbutton, which opens the switch electrically.

2. The lighting enclosure and power switch system of claim 1, where the passive electrical switch is an open-close power switch.

* * * * *